US005592711A

United States Patent [19]

Maier et al.

[11] Patent Number: 5,592,711

[45] Date of Patent: Jan. 14, 1997

[54] PAINT BRUSH APPARATUS HAVING MULTIPLE PAINTING WIDTHS

[76] Inventors: Christopher L. Maier, P.O. Box 890, Manchester Center, Vt. 05255; Kevin R. Busl, P.O. Box 141, Manchester, Vt. 05254

[21] Appl. No.: 514,428

[22] Filed: Aug. 11, 1995

[51] Int. Cl.[6] ..... A46B 15/00

[52] U.S. Cl. ..... 15/106; 15/160; 15/166; 15/201; 15/172

[58] Field of Search ..... 15/106, 159.1, 15/160, 166, 169, 184, 201, 172

[56] References Cited

U.S. PATENT DOCUMENTS

| | | | |
|---|---|---|---|
| 2,329,534 | 9/1943 | Hawkins | 15/201 |
| 2,384,029 | 9/1945 | Hawkins | 15/201 |
| 2,816,305 | 12/1957 | Kravitt | 15/106 |
| 2,917,763 | 12/1959 | Kurschner | 15/106 |
| 4,010,510 | 3/1977 | Belza | 15/192 |
| 4,253,213 | 3/1981 | Marino | 15/192 |
| 5,070,569 | 12/1991 | Wilkins | 15/172 |

FOREIGN PATENT DOCUMENTS

| | | | |
|---|---|---|---|
| 783976 | 4/1935 | France | 15/201 |
| 326629 | 6/1935 | Italy | 15/106 |
| 5-49511 | 3/1993 | Japan | 15/160 |
| 16734 | 7/1914 | United Kingdom | 15/201 |

OTHER PUBLICATIONS

Parade Magazine, Washington Post, 4 May 1952 p. 17.

*Primary Examiner*—Mark Spisich
*Attorney, Agent, or Firm*—Thomas N. Neiman

[57] ABSTRACT

The paint brush apparatus having multiple painting widths is designed in order to provide the user with a paintbrush apparatus that is able to paint in a number of different pre-determined widths that will allow the user to more rapidly finish any painting project. The apparatus is comprised of a handle assembly having lengthwise holes to permit the handle to incorporate internal, movable drive shafts. The drive shafts have a control mechanism such as a slide button or thumbwheel that will allow the extension or retraction of one or both of the shafts. A bristle head assembly has the bush bristles attached and has at least one open slot cut therein. Separate brush inserts are inserted into the slots in the bristle head assembly and are attached to the drive shafts in the handle assembly. The inserts are designed to be constructed of material which will inhibit the sticking of the inserts due to dried paint or debris in the apparatus.

2 Claims, 2 Drawing Sheets

PAINT BRUSH APPARATUS HAVING MULTIPLE PAINTING WIDTHS

BACKGROUND OF THE INVENTION

This invention pertains to painting accessories, and, in particular, to a paint brush having multiple painting widths which allows the operator to easily and quickly change the painting width that he or she is using as is appropriate for the surface and structure being painted.

Many types and designs of paint brushes exist today. Most are fairly simple devices having a single width and are not designed for use in varying situations. Therefore, a number of different brushes are required to complete a job. Changing and cleaning brushes is wasteful and inefficient and a better method to accomplish the job should be found. It is also much more efficient not to have to find resting places for multiple brushes, but rather have a single multiple width brush. There have been some examples of variable bristle brushes found in issued United States patents. Examples of these devices include the U.S. Pat. No. 4,483,036 to A. R. Sayklay for an Artist's Painting Aid issued on 20 Nov. 1984 and the U.S. Pat. No. 2,159,432 issued to W. E. Enns, for a Retractable Brush that was issued on 23 May 1939. Both of these devices are brushes that permit variable painting bristles to be used with a single brush. The Sayklay brush is a unit that contains bristles that are cut at different lengths. This brush is not very useful to individuals painting a structure such as a house because the nature of the brush makes it difficult to put out solid, level layers of paint and does not allow for size adjustment to permit detail painting. The Enns' device is a very complicated mechanism having limited variability in bristle thickness, not in painting width and is simply too costly to manufacture and complete with the costs of standard brushes. What is needed is a simple and effective device that is easy to manufacture and use and is effective in all phases of painting. Additionally, what is needed is an apparatus that saves time and effort and, at the same time, is economical.

It is an object of this invention to set forth a paint brush apparatus having multiple widths which avoids the disadvantages, previously mentioned limitations of typical paint brushes.

SUMMARY OF THE INVENTION

Particularly, it is the object of this invention to set forth a paint brush apparatus having multiple painting widths, for use by individuals in order to make the job of painting much more efficient, comprising a handle assembly; said handle assembly having at least one aperture positioned lengthwise in said handle assembly; said handle assembly further having moveable drive shafts positioned within said apertures for permitting the operator to extend said moveable drive shaft forward from said handle assembly and also permitting the operator to retract said moveable drive shaft into said apertures in said handle assembly; said handle assembly further having a control mechanism for giving the operator control over said moveable drive shaft; a bristle assembly; said bristle assembly having at least one aperture located therein; at least one brush insert piece to be positioned within said bristle assembly aperture; and said brush insert piece having connection means for attaching said brush insert piece to said moveable drive shafts for allowing said brush insert piece to extend outwardly from said bristle assembly when the operator desires to have a different width painting unit and also will retract into said bristle assembly in order to form a single uniform painting unit.

BRIEF DESCRIPTION OF THE INVENTION

Further objects and features of this invention will become more apparent by reference to the following description taken in conjunction with the accompanying figures, in which.

DESCRIPTION OF THE PREFERRED EMBODIMENTS

Figure 2:
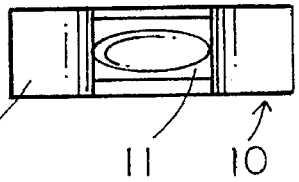
FIG. 2 is a top plan view thereof.
Figure 3:
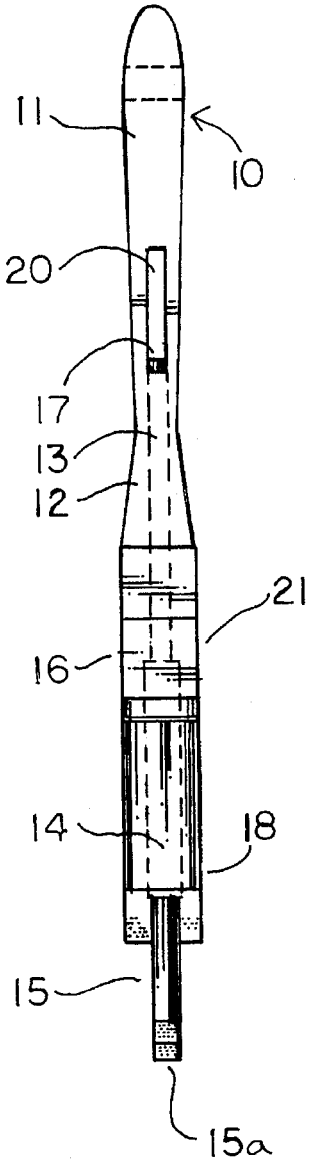
FIG. 3 is a side elevational view thereof.
Figure 1:
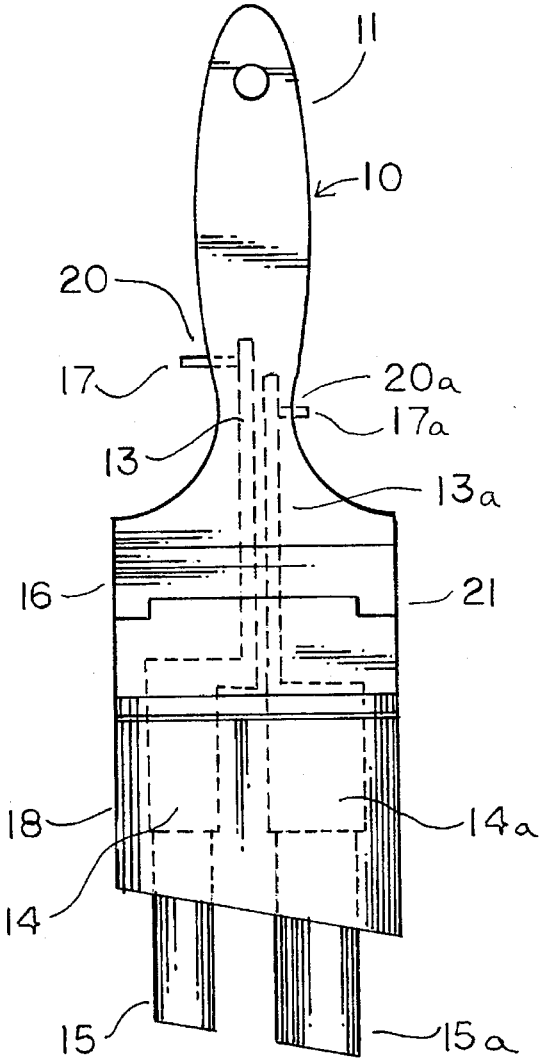
FIG. 1 is a front elevational view of the novel paint brush apparatus having multiple painting widths.
Figure 4:
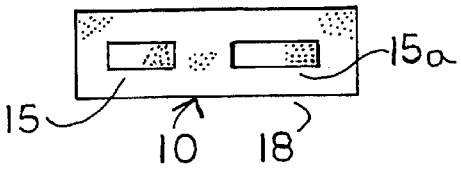
FIG. 4 is a bottom plan view thereof.

As shown in the figures, the novel paint brush apparatus 10 comprises a handle 11 that has at least one aperture 12 and 12*a* positioned lengthwise or longitudinally within the handle 11. Smaller outside slots 20 and 20*a* are positioned on the sides of the handle 11. Moveable drive shafts 13 and 13*a* are square and are positioned back to back and located within the apertures or square channel holes 12 and 12*a* and are connected to control mechanisms—in this case a slide 17 and 17*a*. The control mechanisms allow the user to move the slide into the handle 11 or extending from the handle 11. The handle is connected to a bristle assembly 16 that is comprised of a base section 21 and main brush area 18. Apertures are cut into the base section 21 and the main brush area 18 to permit the positioning of brush inserts 14 and 14*a* that are connected to the shafts 13 and 13*a* in the handle 11. The brush inserts have separate small bristle area 15 and 15*a*.

Figure 6:
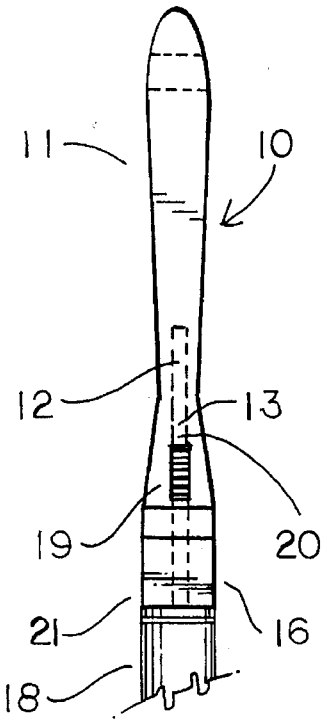
FIG. 6 is a partial side elevational view thereof.
Figure 5:
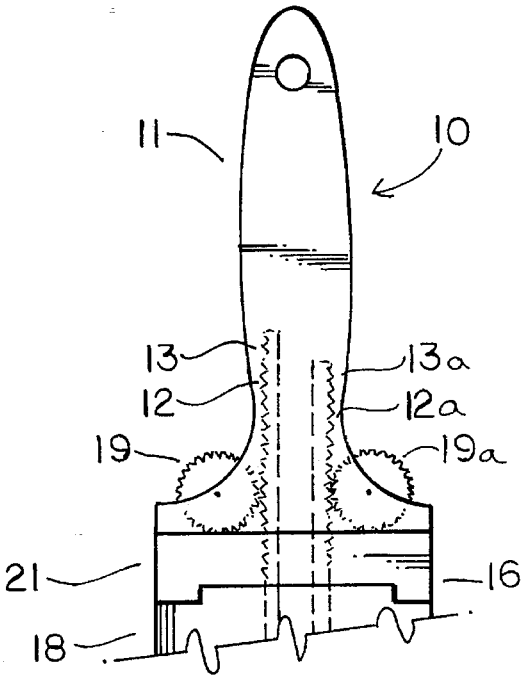
FIG. 5 is a partial front elevational view of an alternate embodiment of the novel paint brush apparatus having multiple painting widths.
Figure 7:
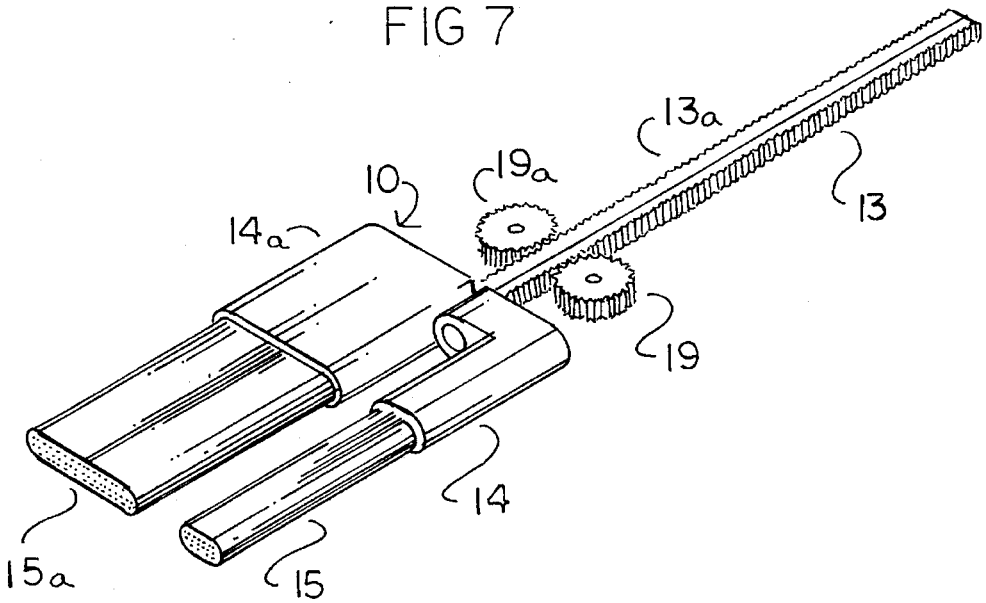
FIG. 7 is an enlarged perspective view of the drive shafts and the inserts of the novel apparatus.

The alternate embodiment shown in FIGS. 5 and 6 is the same as the other version with the exception that the control mechanism is in the form of a thumbwheel 19 and 19*a* that would be meshed with the shafts 12 and 12*a*. The shafts in this case would be grooved or toothed to accept the gearing or extensions in the thumbwheels 19 and 19*a*. The thumbwheels are held in position by means of pins that are machined or molded into holes into the handle 11 of the apparatus 10.

The paint brush apparatus having multiple painting widths has a number of advantages over standard brushes. It is designed to replace two or three different sized brushes. The invention incorporates two smaller brushes assemblies that protract and retract independently the use of the control mechanism on the sides of the handle. In the retracted position, the brush functions as a regular paintbrush. In the extended position, either brush insert may extend independent of each other, enabling one or the other to be used at one time. The extended brush insert push forward a narrow section of the bristles in order to reach areas that could not be effectively reached by the full brush of the paintbrush.

The handle is constructed from wood or plastic which is machined or plastic mold injected. Apertures are drilled lengthwise in the handle to incorporate one or two internal shafts of the brush inserts. The handle is also slotted for the slide button or thumbwheel that extends or retracts the brush insert. The bristle head assembly is mill slotted through the epoxy which holds the bristles in place. The slot length is contingent upon the width of the brush insert intended. Brush inserts are constructed from nylon or plastic to help prevent dried paint from sticking to the insert which may cause it to jam in the handle or brush head assembly. The insert and shaft can be plastic mold injected or can be constructed in two parts and connected by adhesive means and can be connected in a straight line or can be offset by two ninety degree angles. There are two types of shafts the smooth version that is connected to the slide button and the thumbwheel embodiment uses a tooth sided shaft. The insert is mill slotted and the insert bristles are epoxied therein. The bristle length is cut after it is assembled into the handle and the bristle assembly. The slide button screws into a hole in the shaft of the apparatus and the thumbwheel is press fitted into a slot in the handle and a pin is press fitted through the handle and the hole in the center of the thumbwheel.

While we have described our invention in connection with specific embodiments thereof, it is clearly to be understood that this is done only by way of example and not as a limitation to the scope of our invention as set forth in the objects thereof and in the appended claims.

We claim:

1. A paint brush apparatus having multiple painting widths, for use by individuals in order to make the job of painting much more efficient, comprising:

a handle assembly;

said handle assembly comprising a unit of rigid construction;

said handle assembly having apertures positioned lengthwise in said handle assembly;

said handle assembly further having moveable drive shafts positioned within said apertures for permitting the operator to extend said moveable drive shafts forward from said handle assembly and also permitting the operator to retract said moveable drive shafts into said apertures in said handle assembly;

said handle assembly further having a control mechanism for giving the operator control over said moveable drive shafts;

said control mechanism comprising thumbwheel units that are meshed with grooves in each of said moveable drive shafts in order to control the movement of said moveable drive shafts;

said thumbwheel units having connection means for maintaining said thumbwheel units in position;

said handle having slot means for permitting said control mechanism to be connected to said moveable shafts;

a bristle assembly positioned at one end of said handle assembly;

said bristle assembly comprising a base unit;

said base unit having attaching means for the bristles of said bristle assembly;

said bristle assembly having apertures located therein;

brush insert pieces to be positioned within said bristle assembly apertures;

said bristle assembly apertures comprising slotted areas within said base unit of said bristle assembly;

said slotted areas comprising a width dependent upon the width of each of said brush insert pieces;

said brush insert pieces comprising a formed base unit of rigid construction;

said brush insert pieces having attaching means for the positioned of bristles on said brush insert pieces;

said brush insert pieces further having adhesive connection means of single piece construction for attaching said each of said brush insert pieces to said moveable drive shafts independently for allowing said brush insert pieces to extend outwardly from said bristle assembly when the operator desires to have a different width painting unit and also will retract into said bristle assembly in order to form a single uniform painting unit;

one of said brush insert pieces comprising a unit connected to one of said moveable drive shafts in a straight line direct plane; and the other of said brush insert pieces further comprising a unit connected to the other of said moveable drive shafts with at least one ninety degree angle offset.

2. A paint brush apparatus having multiple painting widths, for use by individuals in order to make the job of painting much more efficient, comprising:

a handle assembly;

said handle assembly comprising a unit of rigid construction;

said handle assembly having an aperture positioned lengthwise in said handle assembly;

said handle assembly further having a moveable drive shaft positioned within said aperture for permitting the operator to extend said moveable drive shaft forward from said handle assembly and also permitting the operator to retract said moveable drive shaft into said aperture in said handle assembly;

said handle assembly further having a control mechanism for giving the operator control over said moveable drive shaft;

said control mechanism comprising a thumbwheel unit that is meshed with grooves in said moveable drive shaft in order to control the movement of said drive shaft;

said thumbwheel unit having connection means for maintaining said thumbwheel in position;

said handle having a slot means for permitting said control mechanism to be connected to said moveable shaft;

a bristle assembly positioned at one end of said handle assembly;

said bristle assembly comprising a base unit;

said base unit having attaching means for the bristles of said bristle assembly;

said bristle assembly having an aperture located therein;

a brush insert piece to be positioned within said bristle assembly aperture;

said bristle assembly aperture comprising a slotted area within said base unit of said bristle assembly;

said slotted area comprising a width dependent upon the width of said brush insert piece;

said brush insert piece having attaching means for the positioning of bristles on said brush insert piece;

said brush insert piece further having connection means for attaching aid brush insert piece to said moveable drive shaft for allowing said brush insert piece to extend outwardly from said bristle assembly when the operator desires to have a different width painting unit and also will retract into said bristle assembly in order to form a single uniform painting unit; and said brush insert piece comprising a unit connected to said moveable drive shaft in a straight line direct plane.

* * * * *